United States Patent [19]

Steinbach

[11] 4,165,145

[45] Aug. 21, 1979

[54] RIBBON CONNECTOR CONSTRUCTIONS

[75] Inventor: Thomas M. Steinbach, Park Ridge, Ill.

[73] Assignee: TRW Inc., Elk Grove Village, Ill.

[21] Appl. No.: 864,439

[22] Filed: Dec. 27, 1977

Related U.S. Application Data

[63] Continuation of Ser. No. 672,643, Apr. 1, 1976, Pat. No. 4,089,579.

[51] Int. Cl.[2] ..... H01R 13/54; H01R 13/58

[52] U.S. Cl. ..... 339/91 R; 174/138 F; 339/103 M; 29/630 R

[58] Field of Search ..... 339/75M, 91 R, 103, 339/105, 107, 128, 132, 139, 176 M, 176 MP, 206; 174/138 F, 138 G; 29/630 R, 630 A, 630 B, 630 F, 630 G, 428, 759

[56] References Cited

U.S. PATENT DOCUMENTS

| | | | |
|---|---|---|---|
| 3,409,859 | 11/1968 | Krehbiel | 339/91 R |
| 3,629,803 | 12/1971 | Glutz | 339/206 R X |
| 3,662,321 | 5/1972 | Bury | 339/92 M |
| 3,753,212 | 8/1973 | Yamada et al. | 339/91 R |
| 3,920,306 | 11/1975 | Barnett et al. | 339/103 M |
| 3,936,129 | 2/1976 | Guy | 339/103 R |
| 4,037,906 | 7/1977 | Jayne | 339/206 R X |

*Primary Examiner*—Roy Lake
*Assistant Examiner*—E. F. Desmond
*Attorney, Agent, or Firm*—Neuman, Williams, Anderson & Olson

[57] ABSTRACT

A hood construction for an electrical connector is provided having latching detent portions disposed on opposed end portions of the hood side walls. The detent portions are resiliently spread apart by connector interlocking portions in the course of effecting a secure snap interengagement. In one mode of hood-connector engagement a connector end is received in a slotted hood end portion whereafter the opposed connector end is pivoted into a snap-in engagement.

17 Claims, 6 Drawing Figures

FIG. 1
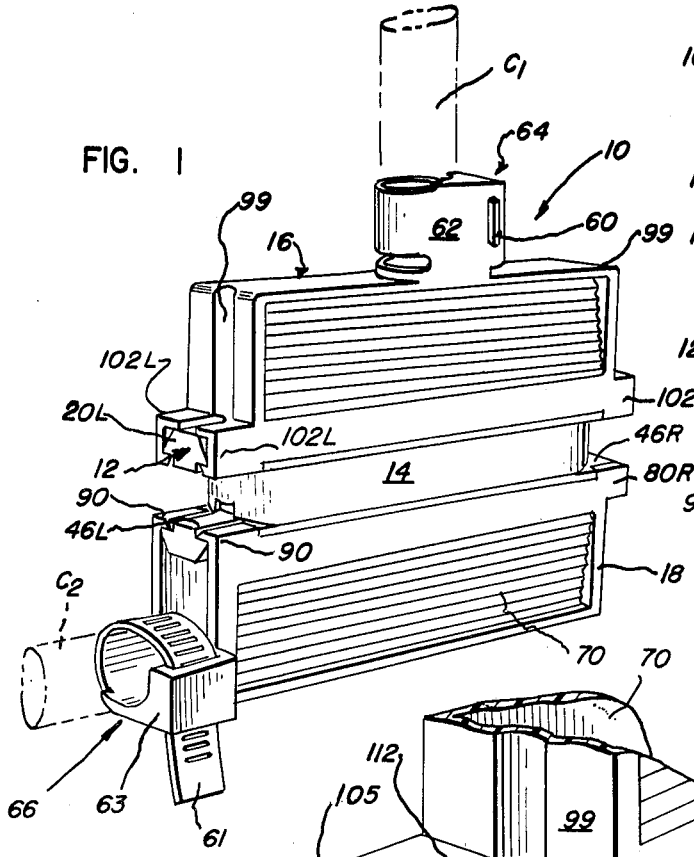
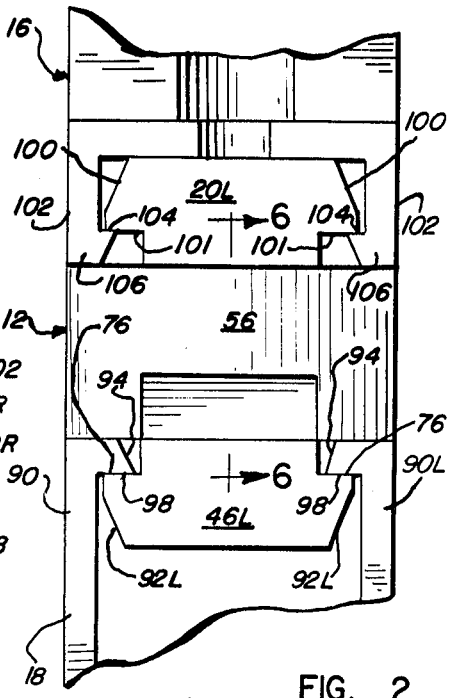
FIG. 2
FIG. 3
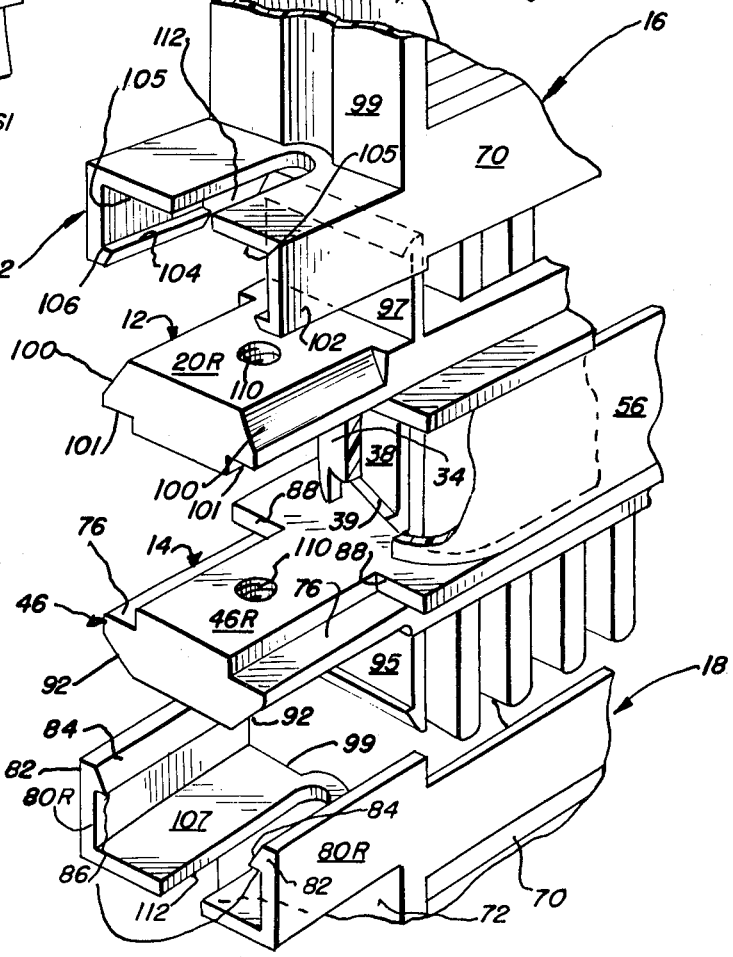

RIBBON CONNECTOR CONSTRUCTIONS

This is a continuation of application Ser. No. 672,643 filed Apr. 1, 1976 now U.S. Pat. No. 4,089,579, issued May. 16, 1979.

This invention relates to a multiple contact ribbon-type termination system, and more particularly pertains to providing conveniently interlocking plug and receptacle connector constructions which may be formed entirely of plastic with the exception of metal contacts disposed therein.

A number of ribbon-type connector constructions and termination systems are known in the prior art. Included in the known connectors are those manufactured by TRW Inc. of Elk Grove Village, Ill. and referred to as Cinch Ribbon connectors. Connectors of the type under consideration are employed in so-called miniature ribbon termination systems or high density systems in which a plurality of wires are terminated in closely adjacent relationship. The individual wires may be connected to individual contacts by various means; such as by soldering or by a solderless technique, e.g., such as is disclosed in McKee and Witte application Ser. No. 443,678, filed Feb. 19, 1974.

Ribbon connectors normally comprise a plastic body which receives and holds a number of wire-engaging contacts. The contacts are formed of an electrically conducting material such as a cadmium-bronze alloy. The contacts are designed to be connected to the wires at a termination end portion, and contact one another in mating pairs at the opposite or mating end to establish electrical continuity therebetween when two connectors are properly joined to one another. Separate rewiring devices such as screws have been used to secure the mated pairs together.

In solderless connectors the termination end portions of the contacts are formed with wire-gripping jaws not only to pierce the insulation covering a wire to effect electrical engagement with an insulation-covered wire, but in addition preferably are formed to prevent strain on the wire-contact joints when the wires are moved and thus prevent inadvertent wire-contact disengagements.

The connectors are made in receptacle (female) and plug (male) form adapted to form connector assemblies. The mating ends of the contacts in the plug are received against mating ends of the contacts of the receptacle to effect engagement whereby the wires connected to the contacts of the receptacle and plug are electrically connected. The contact mating end portions in some prior art connector constructions are surrounded by metal support shells which telescopically engage with one another in the course of the mating interfit. The metal shells provide a connector reinforcing function and in addition may be integrally formed with opposed apertured tab portions to facilitate locking of a connector assembly together by receiving securing means as noted above, and/or to facilitate the mounting of the connectors on a supporting chassis or the like.

It is an object of this invention to provide connector assemblies of the noted type which may be secured together by the simple mating joinder of the two connectors.

It is another object of this invention to provide connector constructions of the type mentioned in which metal shells may be omitted with no deleterious consequences.

It is another object of this invention to provide all-plastic connector receptacle and plug bodies of novel design and having the metal contacts arranged in the usual manner for wire-connecting purposes and for mating with other connectors.

It is a further object of this invention to provide connector constructions in which novel, resilient latching means are provided and which also are adapted to mate with other connectors which do not have such latching means.

It is yet another object of this invention to provide integral plastic connector body constructions which may be molded in unitary form.

The above and other objects of this invention will become more apparent from the following detailed description when read in the light of the accompanying drawings and appended claims.

In one embodiment of the provided invention a plug connector is provided with a plastic body which receives a plurality of parallel aligned contacts arranged in two opposed series each in substantially the same plane. Each contact has a wire-terminating portion for purposes of effecting electrical engagement with a wire conductor. A contiguous mating portion of each contact extends from a central portion of the plug body, adjacent the central longitudinal axis of that body. A plastic skirt, integrally formed with the connector body of the plug, extends from the central body portion in encompassing relation with the mating portions of the contacts. Openings are formed in opposed longitudinal end portions of the skirt. The openings are adapted to receive, in interlocking engagement, plastic resilient latch portions integrally formed with a connector receptacle body and disposed at opposed end portions of a skirt-like portion of that receptacle body. Such interlocking engagement occurs when the larger plug skirt receives said receptacle body skirt-like portion in a snug telescoping relation. The receptacle includes two spaced-apart series of aligned contacts having mating portions which are encompassed by the receptacle body skirt-like portion. The mating portions are spaced to receive said plug contact mating portions therebetween for purposes of effecting a snug contact-to-contact engagement. The connectors may be readily disengaged from their interlocking condition by urging a latch detent portion of a connector receptacle from locking engagement with the opening in the skirt of the connector plug as will hereinafter be described in greater detail. Also, plastic hoods may interlockingly engage each of the connectors as will also be described hereafter.

For more complete understanding of this invention reference will now be made to the drawings wherein:

FIG. 1 is a perspective view illustrating interlocking connector members employing teachings of this invention, with hood members detachably secured to each of the connectors;

FIG. 2 is a fragmentary end elevational view illustrating the nature of the hood-connector attachment means;

FIG. 3 is a fragmentary exploded view of the right end portions of the interlocked connector members of FIG. 1 showing their hood members in spaced relationship;

Figure 4:
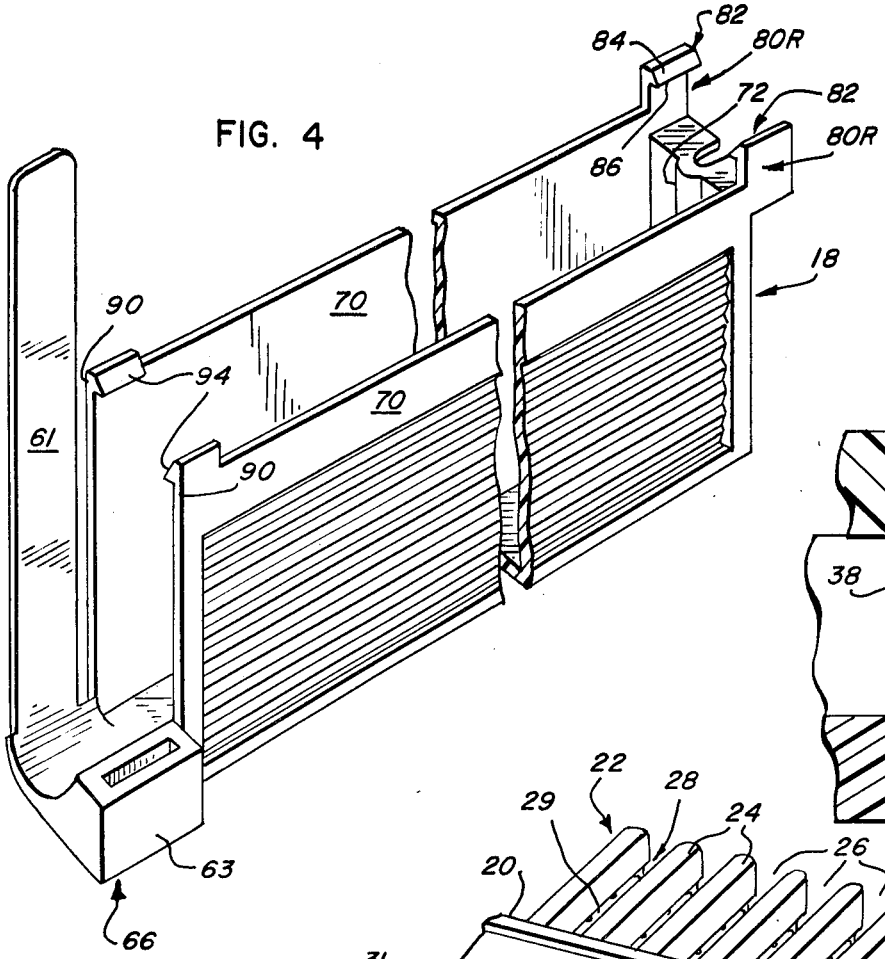
FIG. 4 is a perspective view of a hood member employed in the assembly of FIG. 1.

The connector-hood assembly 10 shown in FIG. 1 includes a receptacle or female connector 12 and a plug or male connector 14 connected to one another in mating relation, and a pair of hoods 16 and 18 attached to the respective connectors. It will be noted that the connectors 12 and 14 illustrated are of the miniature ribbon type commonly employed in high density systems in which a plurality of wires are to be terminated in close relationship to one another. The structure of connector 12 is most clearly seen from FIG. 5 in which it will be noted that it comprises an integral plastic body having a central body portion 20 integrally formed with a conductor-receiving portion 22. The conductor-receiving portion has a plurality of parallel barrier members 24 extending from a central rib (not illustrated) which define therebetween wire-receiving channels 26. Thus portion 22 of the connector 12 has opposed series of channels 26 in which are disposed wire-engaging contacts 28 for purposes of engaging conductors such as insulation-covered wires to be terminated in such contacts.

The specific connector embodiments illustrated are of one solderless type. However, the features of this invention, including the integral interconnecting elements and the hood mounting arrangement may be incorporated to equal advantage in connectors of the solderless type in which no channels are present, as well as in other connector constructions well-known in the art such as the solder type.

Figure 5:
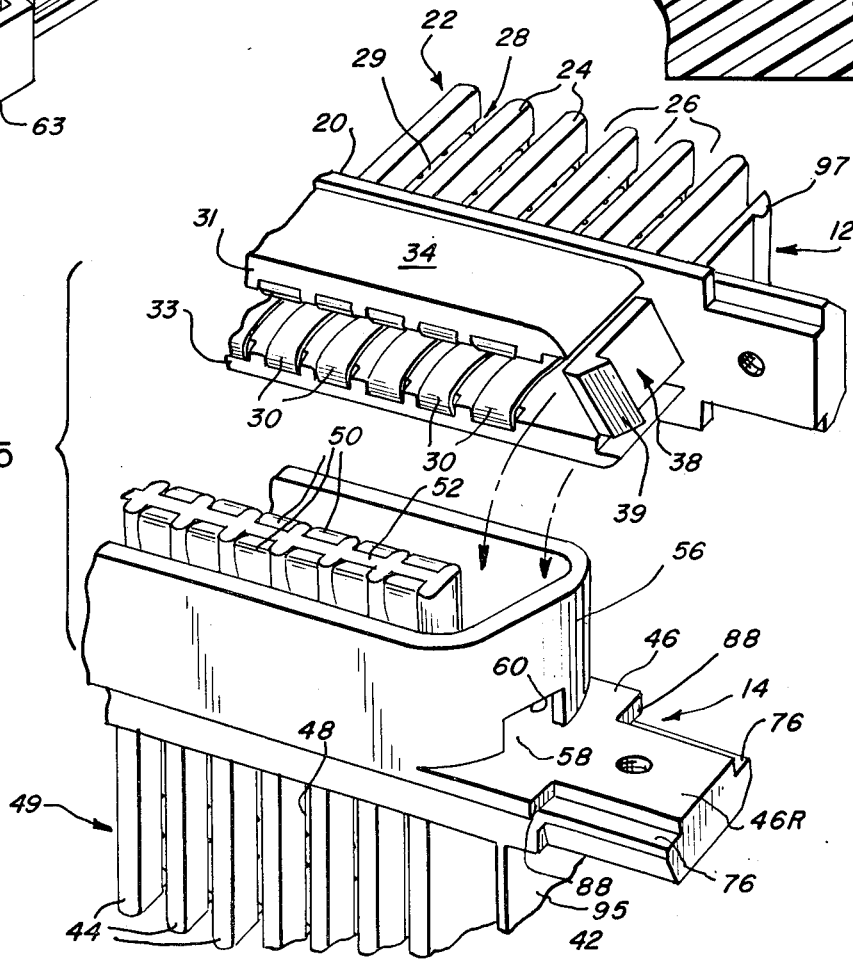
FIG. 5 is a fragmentary perspective view illustrating receptacle and plug connector members made in accordance with this invention prior to being interlocked in a connector assembly.

Contacts 28 include wire termination portions 29 which comprise wire gripping portions to establish electrical contact with the conductor core of a wire, and other portions which serve as a strain relief to assist in preventing removal of the wires from the contacts upon exertion of a force on such wires tending to remove the same from the channels in which disposed. Each contact, in addition to the wire termination portion 29 disposed in each channel 26, has integrally formed therewith a continuous mating portion 30 which extends through the connector portion 20 and extends on the opposite side thereof in a direction oppositely disposed to the conductor-receiving portion 22. A contact construction similar to that disclosed in FIG. 5 currently is in use in the Cinch Ribbon connectors of TRW Inc. noted above and is further described in McKee and Witte U.S. application Ser. No. 443,678, filed Feb. 19, 1974. It will be noted that the mating portions 30 of the opposed series of contacts 28 in the channels 26 extend from one side of body portion 20 of connector 12, as illustrated in FIG. 5, so as to be arranged in two spaced-apart aligned groups or series. These portions of the contacts are received and supported along opposed inner walls of side portions 31 and 33 of depending skirt-like body portion 34 in a known manner. Connector portion 34 is an element of the integral connector body 12 and the connector element in which the contact mating portions are received when effecting a connector assembly. Such skirt-like portions are well-known in the connector art. Each contact mating portion 30 typically is curved outwardly away from the adjacent skirt wall 31 or 33, and has a hook portion at its terminal end which engages a slot at the other edge of the respective channel.

Disposed at opposite end portions of the receptacle connector body 34 are latch members 38, one of which is illustrated in FIG. 5 and in the exploded view of FIG. 3. The latch members 38 are resiliently and integrally formed with the body portion 20 of the connector 12 and have distal locking detent or shoulder portions 39 integrally formed therewith.

It is thus seen that the receptacle connector 12 of FIG. 5 comprises a conductor-receiving portion 22 extending from a central body portion 20 and oppositely disposed to skirt-like portion 34 in which mating portions of contacts 28 are aligned in opposed rows against spaced inner surfaces of the portion 34.

Also illustrated in FIG. 5 beneath the connector 12 is a plug connector 14 adapted to mate with connector 12 for purposes of effecting electrical connection between wires terminated in the contacts 28 of connector 12 and the wires terminated in contacts 48 of connector 14. The contacts 48 are disposed in channels 42 defined by a central longitudinal rib (not shown) and parallel lateral barrier elements 44 extending from a central body portion 46 in a known manner. Contacts 48 have mating portions 50 which extend through the body portion 46 of the connector 14 and on the opposite side thereof in an opposite direction to the wire or conductor-receiving portions 49, in the same manner as the comparable components in the connector construction 12 above described. The contact mating portions 50 extend from the connector portion 46 adjacent the central longitudinal axis of such connector and are supported on a central insulator portion 52 comprising an integral portion of the connector body 14.

Figure 6:
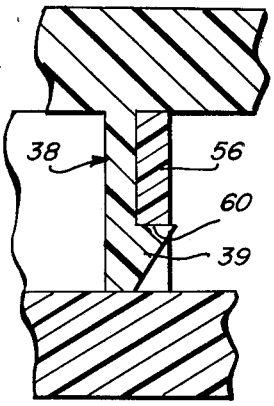
FIG. 6 is a fragmentary sectional view taken on line 6—6 of FIG. 2.

The contact mating portions 50 and the central insulating support 52 are centrally disposed of an encompassing skirt 56. The skirt 56 is integral with the body 14 and has openings 58 in opposed end portions. The relative dimensions of the connectors 12 and 14 are such that when the receptacle 12 and plug 14 are interconnected into a connector assembly, skirt-like body portion 34 of connector 12 is snugly received within the inner periphery of skirt 56 of connector 14. Simultaneously the resilient latches 38 are biased inwardly as the tapered detent portions 39 slide along the end portions of the skirt 56 overlying the openings 58. When skirt-like portion 34 is fully received within skirt 56, and the undersurface of portion 20 of connector 12 abuts the upper edge of skirt 56 of connector 14 as illustrated in FIG. 5, the locking detent portions 39 of latch members 38 will snap into place in the openings 58, thereby effecting an interlock with ledge 60 as is more clearly seen in the sectional view of FIG. 6.

Of course, as the connectors 12 and 14 are being so interconnected, the contact mating portions 50 of connector 14 slide between and engage the oppositely aligned contact mating portions 30 of connector 12 in the usual manner to effect electrical contact between each such pair of contacts and therefore between the wires connected to those contacts.

It is thus seen that by means of the above-described interlock constructions a connector receptacle and plug may be readily interlocked in mating engagement simply by telescoping the skirt of the receptacle connector within the skirt portion of the opposed plug connector until the latch shoulders 39 snap into locking engagement with the openings 58 formed in the plug connector skirt portion whereafter the two connectors are in a desired rigid state of assembly without the necessity for employing additional securing means.

FIG. 3 illustrates the connectors 12 and 14 in interlocking relationship, with a portion of the skirt 56 of the connector 14 broken away to show the disposition of the latch 38 in the normal position of connector assembly. To enable disengagement of the connector members 12 and 14 to be effected, one (or both) of the latch ends forming a shoulder 39 is urged inwardly toward the center of the connector 12 with which integrally formed until the shoulder 39 disengages from locking engagement with ledge 60 of the opening 58.

It will be noted from FIGS. 3 and 5 that the opposed portions of the skirt 56 in which the openings 58 are formed are not disposed in parallel relationship and are not disposed at right angles to the longitudinal side wall portions of the respective skirt. The two latches 38 are similarly oriented on connector 12. The resulting generally trapezoidal configuration assures proper polarization of connectors being joined, to insure the reception of the overlying skirt portion 34 and contact terminal portions therein in desired relationship relative to the contact terminal portions 50 disposed within skirt 56 of the plug contact 14. Thus proper interconnection is assured between the wires terminated in the contacts of the connector 12 and the wires terminated in the contacts of the connector 14.

Each of the connectors 12 and 14 may receive a protective hood which overlies the conductor-receiving portions of the connectors in the manner illustrated in FIG. 1. The illustrated hoods 16 and 18 are of integral plastic design. The structure of hoods 16 and 18 are the same with the exception of the location of the strain relief or cable clamp portions and the absence of an end wall adjacent strain relief 66 as is most clearly seen from FIGS. 1 and 4. Hood 16 has a cable clamp 64 comprising a flexible lock strap 60 which may secure a cable C, (illustrated in phantom lines in FIG. 1) to a slotted clamp bracket portion 62 by a one-way tooth engagement in the bracket. Clamp 64 and bracket portion 62 are integrally formed with the upper surface of hood 16. Hood 18 has a cable clamp 66 comprising an integral flexible lock strap 61 which may secure a cable such as cable C2 (also illustrated in phantom lines in FIG. 1) to a slotted clamp bracket portion 63 integrally formed with an end portion of the hood member 18. Flexible strap portion 61 of clamp 66 is adapted to snugly engage the periphery of a cable which enters from the side of the hood and contains wires which are to be terminated in the channels of the connector 14 engaged therewith. Clamp 60 is similarly adapted to engage cable C1 entering the top of hood 16, and both clamps prevent axial forces exerted along the length of the cables from pulling the individual terminated wires within the connectors from engagement with the contacts therein.

It will be noted from FIG. 4 that hood 18 comprises opposed parallel wall portions 70 interconnected at one end by means of end wall 72. The side walls 70 are free to flex laterally relative to each other at their ends adjacent the cable clamp 66. The hood 18 is assembled to connector 14 by wedging right end portion 46R of chassis 46, illustrated in FIGS. 3 and 5, between spaced retention arms 80R of the hood 18 also clearly seen in FIG. 4, and simultaneously wedging left end portion 46L of the plug body between spaced hood retention arms 90, see FIG. 2, in the course of a simple "snap" action.

It will be noted that each hood retention arm 80R has integrally formed therewith at its end limit an inwardly disposed shoulder 82 having a beveled outer surface 84 and an underlying planar surface forming a shoulder 86. The opposed surfaces 86 abut opposed planar surfaces 76 formed on the connector portion 46R as seen in FIG. 5 when connector 14 and hood 18 are interlocked. In such condition the innermost edges of the retention arms 80 are adjacent shoulder 88 thereby functioning as one stop limiting slidable movement of the hood relative to the body surface 76. Since the structure of the right end portions of the connector and hood are similar to the left end portions as is obvious from the drawings, a similar abutment stop is present in the left portion of the assembly of FIG. 1.

In the course of the wedging action to effect a "snap" interlock, opposed downwardly beveled surfaces 92L on body portion 46L (see FIG. 2) engage bevel edge portions 94 illustrated in FIGS. 4 and 5 and are urged downwardly between the retention arms 90 which are integrally formed with the hood walls 70 and oppositely disposed to the retention arms 80. The downwardly-beveled surfaces 92L spread apart the upwardly beveled surfaces 94 of the retention arms 90, concomitantly spreading such arms 90 apart to enable the left portion of connector 14 to snap below planar surface portions 98 of the retention arms 90 as seen in FIG. 2. In such position surfaces 98 are in overlying engagement with opposed planar surfaces 76 of the connector body portion as is also illustrated in FIG. 2. Either a sliding interconnection or a similar wedging action is effected between the chassis portion 46R and arms 80R at the opposite end.

Resilient fingers 95 integrally formed with the body portion 46 of connector 14 (see FIGS. 3 and 5) are adapted to mount connector 14 on an apertured supporting panel or chassis (not illustrated) by means of a snap-in action in a manner similar to that disclosed in Kirby U.S. Pat. No. 3,824,552 of July 16, 1974. In the embodiment illustrated in the Kirby patent the mounting clips and connector body are discrete elements secured together. Connector 12 has resilient integral fingers 97 also seen in FIGS. 3 and 5 which function in the same manner as fingers 95.

Hood 16 is connected to connector 12 in the manner above described with respect to the connection between hood 18 and connector 14. The left portion 20L of body portion 20 of connector 14 snaps between resilient arms 102L as seen in FIG. 2 while simultaneously body portion 20R of connector 12 (FIG. 3) having upwardly beveled surface portions 100 wedge retention arms 102 of hood 16 apart until planar surface portions 104 of shoulders 106 snap in place beneath planar surfaces 101 of connector body portion 20R.

The intervals between surfaces 104 and overlying planar portions 105 of hood 16 are preferably such as to snugly receive the thickness of the connector portion 20R therebetween. The intervals between shoulder surfaces 86 and planar surface portions 107 of hood 18 similarly are preferably such as to snugly receive the thickness of the connector body portion 46R therebetween. The relative dimensions of the corresponding left end portions of the assembly are similar.

The hoods 16 and 18 are readily disengaged from an engaged connector by merely spreading the hood retention arms disposed at either hood end sufficiently to allow disengagement of the connector from between the hood arms.

Apertures 110 in the connector body portions, and slots 112 in the hood end portions (FIG. 3) facilitate engagement with discrete securing means (not illustrated) which may be employed for additional securing purposes if desired when the illustrated elements are secured together or mounted on a support or the like (not illustrated).

It will be appreciated that latch openings may be provided in separately attached skirts which may be discrete connector elements formed of metal, and such skirts need not be integral with the connector body. Resilient latch fingers may be of designs and materials other than those above described and similarly need not be integral with the connector bodies. Latch fingers and openings are located so as not to interfere with mating with connectors which do not have contemporary latching parts. Thus universal mating ability is retained while adding a single convenient latching arrangement.

It is also seen from the foregoing that integral plastic plug and receptacle connector bodies may be formed in plastic molding operations. The preferred embodiments of connector bodies above described have connecting means integrally formed therewith thereby dispensing with the need for discrete interconnecting means and a separate assembly step. The connector members are readily latched to one another in an assembly as the contact mating portions of the two connectors are interfitted into electrical contact. The provided connector constructions may be molded of a plastic such as a polyester and may be formed without requiring an assembly step with metal securing parts; the provided connectors effect connector assemblies in a minimum amount of time and assembly costs. The provided connector constructions are also adapted to readily latch to protective hood members or the like by simple "snap" connections in the manner above described.

In view of the many modifications which may be made of this invention in light of the teachings above made, it is intended that the scope of this invention be limited only by the appended claims.

What is claimed is:

1. A hood construction for an electrical connector having projecting portions on opposed end portions; said hood comprising a body portion; first engagement portions at one end portion of said hood defining a slot with adjacent hood portions for snugly receiving the projecting portions of one end portion of such connector; portions of said hood at the other end portion thereof being readily flexible relative to said body; second engagement portions on said flexible portions for snap engagement with the projecting portions at the other end portion of such a connector having one end portion engaged in said slot whereby said hood is retained on such a connector.

2. A hood construction as in claim 1 wherein said flexible portions are disposed on opposite sides of said connector.

3. A hood construction as in claim 2 wherein said flexible portions are resiliently movable toward and away from one another and each has a second engagement portion extending inwardly of said body toward the other flexible portion.

4. A hood construction as in claim 3 wherein said body portion includes side walls and said flexible portions constitute portions of said side walls.

5. The hood construction of claim 1 in combination with an electrical connector having a body of electrically insulating plastic including metal wire-engaging contacts disposed therein; said connector having opposed projecting end portions extending from said body in which said contacts are disposed; one connector end portion being in snug interfitting engagement in said slot at said hood one end portion, and the other connector end portion being in resilient, interlocking engagement with said engagement means of said hood other end portion.

6. The hood construction of claim 5 in which said connector end portions extend from stop shoulders; said shoulders being disposed adjacent inner ends of said engagement means at opposed connector end portions whereby relative movement between said connector and hood is obviated.

7. A hood construction for an electrical connector having laterally projecting portions at opposed end portions, said hood comprising a body portion having opposed side walls; inwardly projecting engagement means extending from first end portions of said walls and defining slots with adjacent hood portions for snugly receiving the laterally projecting portions of one end portion of such connector; inwardly projecting engagement means extending from second end portions of said hood side walls; said second end portions of said side walls being readily flexible relative to each other whereby laterally projecting portions of such connector may engage said projecting engagement means extending from said hood second wall portions and be urged therebetween as such connector one end portion laterally projecting portions are inserted in said hood first end portion slots.

8. The hood construction of claim 7 in which said engagement means of said side wall second end portions have cam surfaces for facilitating spreading apart of said side wall second end portions.

9. The hood construction of claim 1 in which cable-strain relief means are formed integrally with said hood body portion for preventing forces imparted to said hood from being imparted to such electrical connector employed therewith.

10. A hood construction for an electrical connector having laterally projecting portions at opposed end portions; said hood comprising opposed side walls; said hood having a projecting slotted portion disposed adjacent one end portion of said hood side walls for snugly receiving in interfitting engagement projecting portions disposed on an end portion of such electrical connector; the interfitting engagement between said hood slotted portion and such projecting portions being adequate to maintain such connector in fixed position relative to said hood; inwardly projecting engagement means disposed on end portions of said hood side which end portions are oppositely disposed to said hood projecting portion; said inwardly projecting engagement means being located relative to the hood projecting end so as to snugly engage surface portions of projecting portions on an opposite end portion of said connector in retaining engagement when such connector is in interfitting engagement with the hood projecting end portion; said hood walls from which said engagement means project being resiliently movable relative to each other for snap engagement of said detents thereon over such connector end portions to be engaged thereby.

11. In combination a hood for an electrical connector comprising a main body portion having first opposed wall portions resiliently laterally movable relative to each other; inwardly projecting engaging means disposed on each of said first opposed wall portions; a second hood end portion spaced from said first opposed wall portions having opposed, inwardly projecting engagement means defining a slot; an electrical connector comprising a main body and having a plurality of wire-engaging contact portions mounted in said connector body so as to be accessible from the connector exterior; said connector having opposed projecting end portions; one of said end portions being snugly received in said hood second end slot and the other of said connector end portions being resiliently engaged by said engaging means of said hood first wall portions in a connector hood interlocking engagement; said hood main body enveloping said connector contact portions in said interlocking engagement.

12. A method for interconnecting a hood having a first slotted end portion defined by opposed detents and adjacent hood portions, and an opposed second end portion including inwardly projecting detents resiliently movable relative to each other, with a connector having opposed end portions with laterally projecting portions; such projecting portions being snugly receivable between said detents, comprising the steps of inserting the laterally projecting portions of one end portion of said connector in the hood slotted end in a slidable interfit; spreading apart the detents opposed to the slotted end portion by means of said connector laterally projecting portions of the second connector end portion, and snapping the spaced detents behind such laterally projecting portions of said connector second end portion in an interlocking engagement with the opposed detents in said slidable interfit.

13. A method for interconnecting a hood having slot defining portions at one end and a latching shoulder on a resiliently movable flexible portion at the opposite end with a connector having opposed projecting end portions; comprising the steps of inserting the projecting portion of one end of said connector in the slot at said one end of said hood in a slidable interfit; flexing said resiliently movable portion by means of the second projecting end portion of said connector, and snapping said latch shoulder behind such second end portion in an interlocking engagement.

14. A hood construction for an electrical connector comprising a main body portion having a first end portion with opposed walls resiliently laterally movable relative to each other; inwardly projecting engagement means disposed on each of the resiliently movable walls having beveled outer surface portions for facilitating spreading apart thereof and of said opposed walls of said first hood end portion on which disposed by insertion of a connector end therebetween; a second end portion opposed to said first end portion having opposed walls with laterally inwardly projecting engagement means; each of the latter engagement means and an adjacent hood body portion defining an interval adapted to snugly receive a connector end portion therein.

15. A hood construction for an electrical connector comprising a main body portion having a first end portion with opposed walls resiliently laterally movable relative to each other; inwardly projecting engagement means disposed on each of the resiliently movable walls; a second end portion opposed to said first end portion having opposed walls with laterally inwardly projecting engagement means; each of the latter engagement means and an adjacent hood body portion defining an interval adapted to snugly receive a connector end portion therein; said hood first and second engagement means having beveled outer surface portions for facilitating spreading apart thereof and of said opposed wall portions with which engaged, whereby a connector may simultaneously spread said hood engagement means apart at opposed end portions thereof and pass therebetween.

16. A hood construction for an electrical connector comprising a main body portion having a first end portion with opposed walls resiliently laterally movable relative to each other; inwardly projecting engagement means disposed on each of the resiliently movable walls and configured to facilitate spreading apart of said walls upon engagement with a connector; a second end portion opposed to said first end portion having opposed walls with laterally inwardly projecting engagement means; each of the latter engagement means and an adjacent hood body portion defining an interval adapted to snugly receive a connector end portion therein.

17. The hood construction of claim 16 in which said projecting engagement means of said hood first and second end portions are arranged in axial alignment.

* * * * *